US010895082B1

(12) United States Patent
Werlinger

(10) Patent No.: US 10,895,082 B1
(45) Date of Patent: Jan. 19, 2021

(54) REBAR CAGE FABRICATION SYSTEM AND RELATED METHODS

(71) Applicant: Gary Werlinger, Gilbert, AZ (US)

(72) Inventor: Gary Werlinger, Gilbert, AZ (US)

( * ) Notice: Subject to any disclaimer, the term of this patent is extended or adjusted under 35 U.S.C. 154(b) by 453 days.

(21) Appl. No.: 15/634,743

(22) Filed: Jun. 27, 2017

(51) Int. Cl.
*E04G 21/16* (2006.01)
*E04C 5/06* (2006.01)

(52) U.S. Cl.
CPC ..... *E04G 21/165* (2013.01); *E04C 5/0622* (2013.01)

(58) Field of Classification Search
USPC ..... 29/281.1, 559; 269/69, 76, 287, 296
See application file for complete search history.

(56) References Cited

U.S. PATENT DOCUMENTS 5,904,347 A * 5/1999 Lin ..... B23K 37/0452 269/76
7,624,488 B2 * 12/2009 Lum ..... B25B 5/14 269/287
8,496,237 B2 * 7/2013 Rolle ..... B23K 37/0452 269/287
8,914,979 B2 * 12/2014 Venskus ..... B23Q 1/012 29/281.1
9,815,151 B2 * 11/2017 Simmons ..... B23K 37/0533
2014/0077434 A1 * 3/2014 Chang ..... B23Q 3/00 269/287
2019/0154194 A1 * 5/2019 Leblanc ..... B66C 23/62

* cited by examiner

*Primary Examiner* — Joseph J Hail
*Assistant Examiner* — Shantese L McDonald
(74) *Attorney, Agent, or Firm* — Adam R. Stephenson, Ltd.

(57) ABSTRACT

Implementations of rebar jigs may include: a ring including a first member and a second member. The first member may be configured to couple to the second member through a second connector. The rebar jig may also include a stand including a first leg, a second leg, and a support bar. The support bar may be positioned between the first leg and the second leg. The ring may be configured to receive three or more rebar thereon through at least three pegs coupled to a perimeter of the ring. The stand may couple with the ring through two or more couplers.

15 Claims, 13 Drawing Sheets

REBAR CAGE FABRICATION SYSTEM AND RELATED METHODS

BACKGROUND

1. Technical Field

Aspects of this document relate generally to systems and devices used in construction. Specific implementations are used in constructing large structures, such as bridges for roads and freeways.

2. Background

A caisson is a watertight retaining structure used to work on the foundation of a bridge, freeway bridge, or pier. Structural caissons are reinforced concrete structures formed by pouring concrete into a hollow cylindrical form. Rebar is included in the concrete to provide structural support to the caisson throughout its life span.

SUMMARY

Implementations of rebar jigs may include: a ring including a first member and a second member. The first member may be configured to couple to the second member through a second connector. The rebar jig may also include a stand including a first leg, a second leg, and a support bar. The support bar may be positioned between the first leg and the second leg. The ring may be configured to receive three or more rebar thereon through at least three pegs coupled to a perimeter of the ring. The stand may couple with the ring through two or more couplers.

Implementations of rebar jigs may include one, all, or any of the following:

The ring may include a shape including one of a circle, a rectangle, a triangle, an ellipse, and a square.

The rebar jig may further include a second support bar extending from the support bar to couple with the second member of the ring.

The two or more couplers may be secured to the stand through two or more pins.

The first connector and the second connector may be secured to the ring through one or more pins.

The first leg and the second leg may have a height and the height may be adjustable through a telescoping rod included therein.

The support bar may have a width and the width may be adjustable through use of telescoping portions coupled to both the first leg and to the second leg.

Implementations of rebar jigs may include: a ring having a first member and a second member. Each of the first member and the second member may include two or more adjustable pegs each configured to receive a rebar. The rebar jig may also include a connector configured to couple the first member with the second member and a stand including a first leg, a second leg, and a support bar. The support bar may be coupled between the first leg and the second leg. Each leg may include a first portion and a second portion. The ring may couple to each of the first leg, the second leg, and the support bar of the stand through two or more couplers.

Implementations of rebar jigs may include one, all, or any of the following:

The ring may include a shape including one of a circle, a rectangle, a triangle, an ellipse, and a square.

The two or more adjustable pegs are adjustable through a track included in a surface of the ring.

The rebar jig may further include a second support bar extending from the support bar to couple with the second member of the ring.

The two or more couplers may be secured to the stand through two or more pins.

The first connector and the second connector are secured to the ring through one or more pins.

The second portion of each of the first leg and the second leg has an adjustable height through a telescoping rod included therein.

The support bar has a width and the width may be adjustable through use of telescoping portions couple to both the first leg and to the second leg.

Implementations of a method for manufacturing a rebar structure may include: providing a rebar jig, the rebar jig may include a ring having a first member and a second member. The method may also include coupling three or more rebar to three or more adjustable pegs included on the rebar jig. The three or more rebar may be held in a desired position through the ring substantially perpendicular to the ring. The method may also include forming a rebar structure by coupling one or more substantially circular rebar to the three or more rebar in two or more places. The method may also include removing one of the first member and the second member of the ring from the jig and removing the rebar structure from the jig.

Implementations of a method for manufacturing a rebar structure may include one, all, or any of the following:

The ring may include a shape including one of a circle, a rectangle, a triangle, an ellipse, and a square.

The three or more adjustable pegs may be adjustable through a track included in a surface of the ring.

The method may further include coupling the rebar jig to a stand.

The method may further include adjusting a height and a width of the stand.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended rebar jigs and related methods will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such rebar jigs and related methods, and implementing components and methods, consistent with the intended operation and methods.

Figure 1:
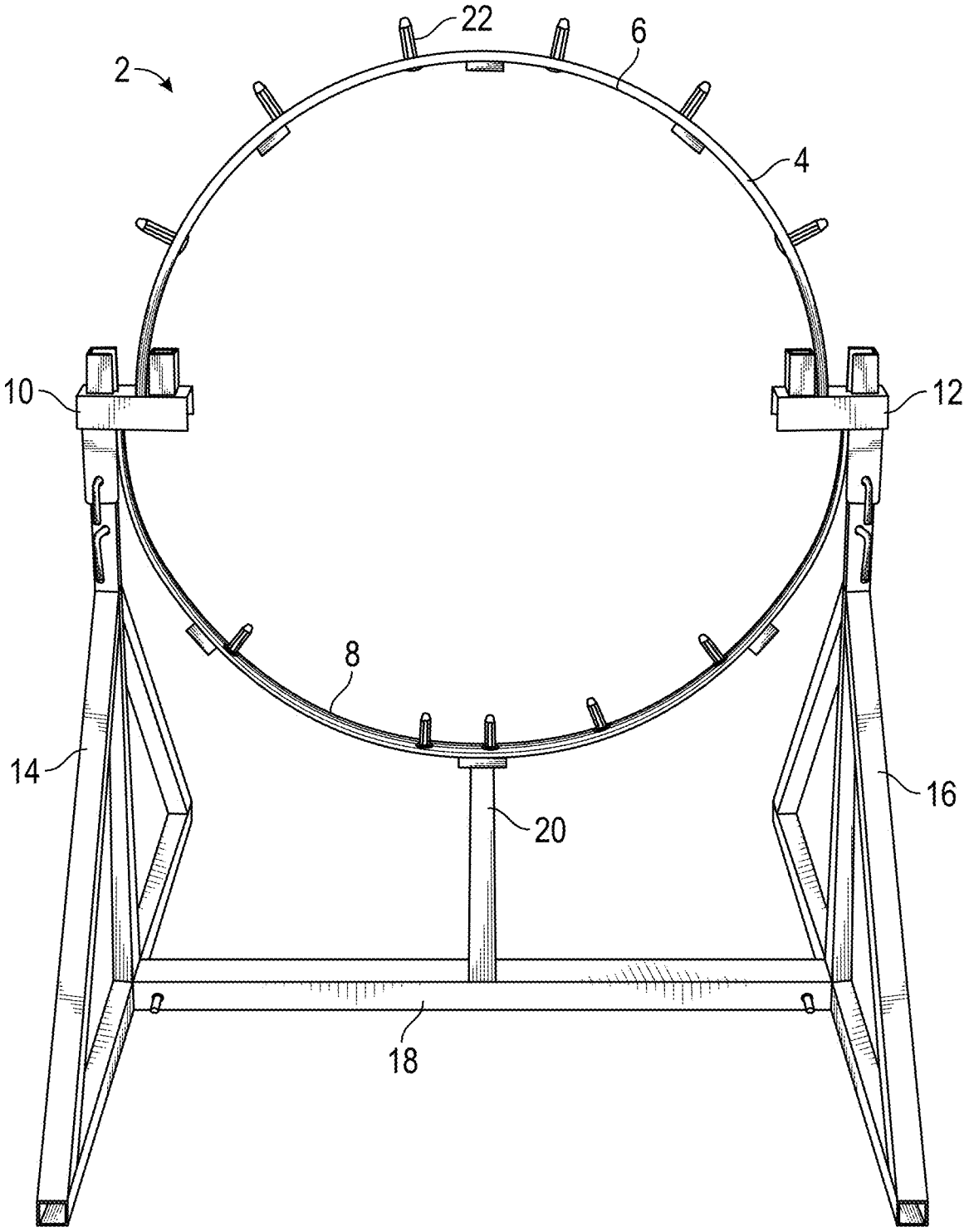
FIG. 1 is a front view of an implementation of a rebar jig.

Referring to FIG. 1, an implementation of a rebar jig 2 is illustrated. The rebar jig 2 includes a ring 4 having a first member 6 and a second member 8. In various implementations, the ring may be in the shape of a circle, a rectangle, a triangle, an ellipse, a square, or any other shapes that may be useful in forming rebar structures. The first member 6 of the ring 4 may be coupled to the second member 8 through a first connector 10 and a second connector 12. The ring 4 is coupled to a stand 14. By non-limiting example, the ring may be coupled to the stand through two or more couplers. The stand 14 may include a first leg 14, a second leg 16, and a support bar 18. In various implementations, the first leg 14 and the second leg 16 may include a triangle shape, as shown, providing a wide base to support the weight of rebar placed on the jig. In other implementations, a rebar jig 2 may have a second support bar 20 extending from the support bar 18 and coupling with the second member 8 of the ring 4.

Figure 11:
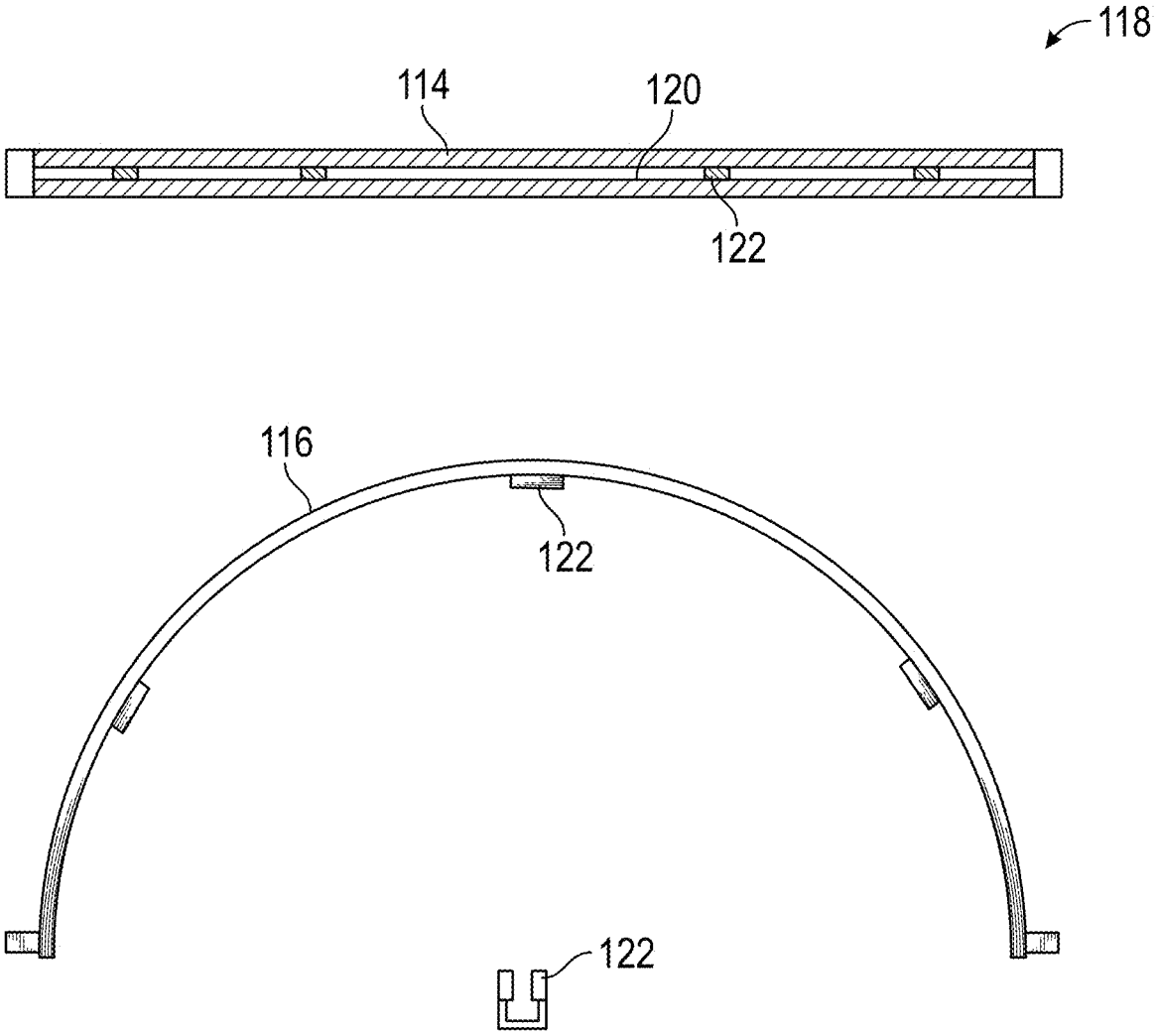
FIG. 11 is a top view and a front view of an implementation of a first member of an implementation of a rebar jig.
Figure 12:
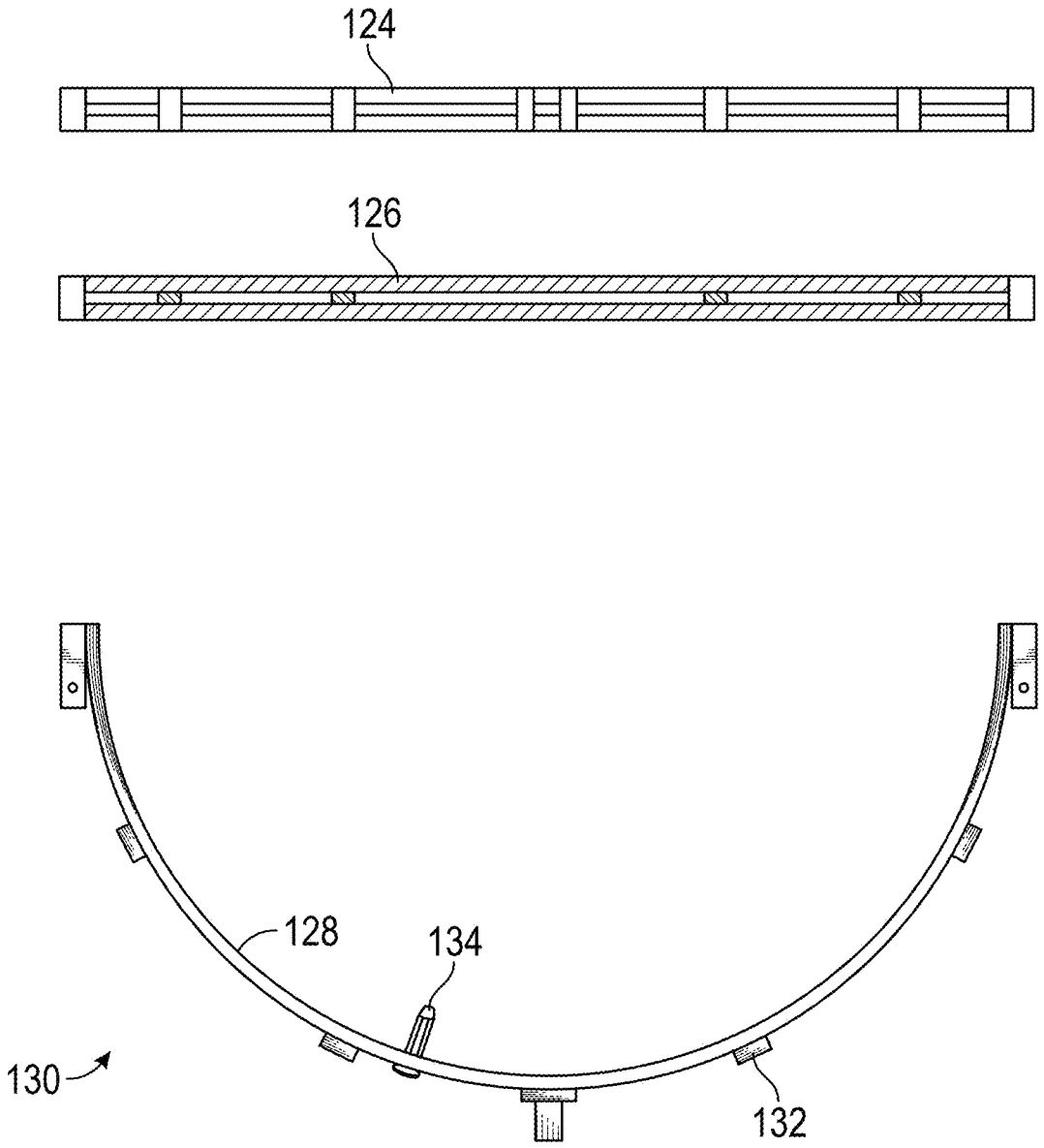
FIG. 12 is a top view, bottom view, and front view of an implementation of a second member of an implementation of a rebar jig.

In various implementations, the ring is configured to receive three or more rebar through/at at least three pegs 22 coupled to a perimeter of the ring 4. In various implementations, the three or more pegs may be included in/coupled into a track included in the surface of the ring. The pegs may be adjustable in position around the ring 4 to accommodate different sized rebar structures. In various implementations, the distance the pegs 22 extend away from the ring may be adjustable as well through the mechanism that couples the pegs into the track. Illustrations of the structure of the tracks included in the first member and the second member are shown in FIGS. 11 and 12, respectively. In various systems, rebar may also be placed on the first connector 10 and second connector 12 adjacent the first member (see FIGS. 13 and 14 for rebar placed in this position).

Figure 2:
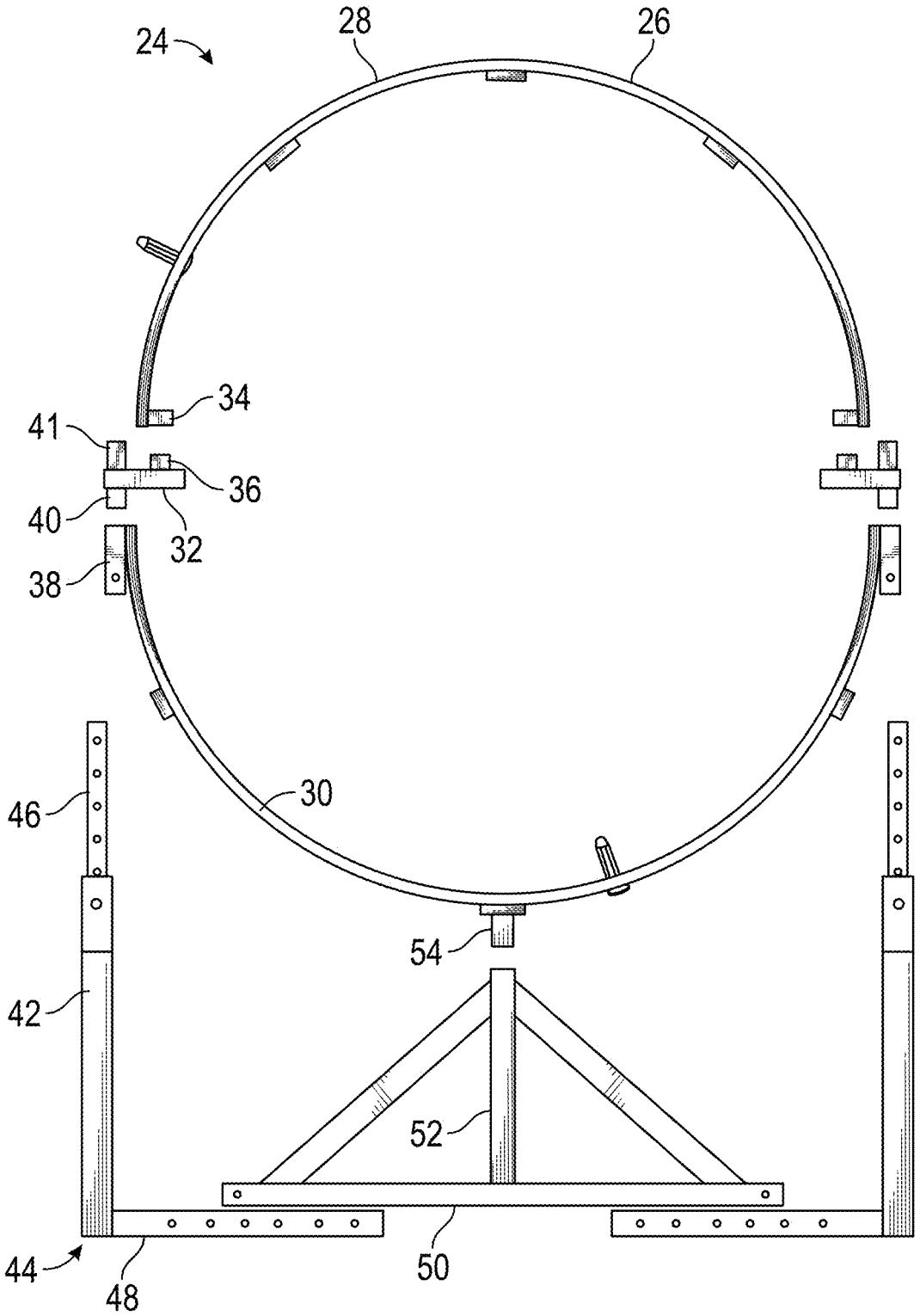
FIG. 2 is an exploded view of an implementation of a rebar jig.

Referring to FIG. 2, an implementation of all the pieces of a rebar jig is illustrated. In this illustration, the pieces are shown in an exploded view to show where each piece couples to another. For brevity for the purposes of description in this document, the coupling of pieces is only described on one side of the rebar jig. All connections are the same on the other, symmetrical, side of the jig. For example, the ring is made of the first member 28, the second member 30 and two connectors 32. The first member 28 includes a sleeve 34 that couples with a tubing 36 on the connector. In various implementations, the sleeve may measure about 1.5 inches while the tubing measures about 1.25 inches. The tubing may be made of metal, composites, plastics, or other suitable materials known in the art. The second member 30 likewise couples with the connector 32 through a sleeve 38 that sits over the tubing 40 on the connector. A third piece of tubing 41 on the connector 32 may be used to hold a rebar as described above.

The sleeve 38 on the second member then couples with a leg 42 of the stand 44 through a telescoping rod 46 which inserts into the sleeve. The desired height of the jig 24 is secured through the use of a pin inserted into openings at the desired height that holds the rod and sleeve in position at that location, thereby coupling the second member to a leg 42 of the stand 44. In various implementations, two or more pins may be used on each leg. One pin may be used to secure the height of the telescoping rod and a second pin may be used to secure the second member to the telescoping rod. Other implementations of a rebar jig may utilize straight pins, screws and bolts, cotter hairpins, and other suitable fasteners known in the art to secure pieces of the jig together.

In various implementations, the legs 42 of the stand 44 are coupled to the support bar 48 of the stand through telescoping portions of the legs 42. The telescoping portions slide into the support bar 48 of the stand 44. The telescoping portions may allow the stand to be set to different widths as necessary for building rebar cages of various sizes. In various implementations, the telescoping portions 48 are made from about 1.25 inch tubing and the support bar 50 is made from about 1.5 inch portions. Both the telescoping portions 48 and the support bar 50 have one or more holes configured to receive pins to secure the width of the stand 44. In various implementations, the holes in the telescoping portions may be 3 inches apart. The holes in the support bar may be 1 inch from the either end of the bar. The holes may be 0.5 inch in diameter. In other implementations, the support bar may be coupled to a second support bar 52. The second support bar may couple to the second member of the ring through tubing coupled to the second member. By non-limiting example, the second support bar may have a height of at least 16 inches. The tubing 54 on the second member may be about 1.25 inch tubing and may fit inside the second support bar. The tubing may be secured to the second member through welding, adhesive, or other suitable coupling methods known in the art.

Figure 3:
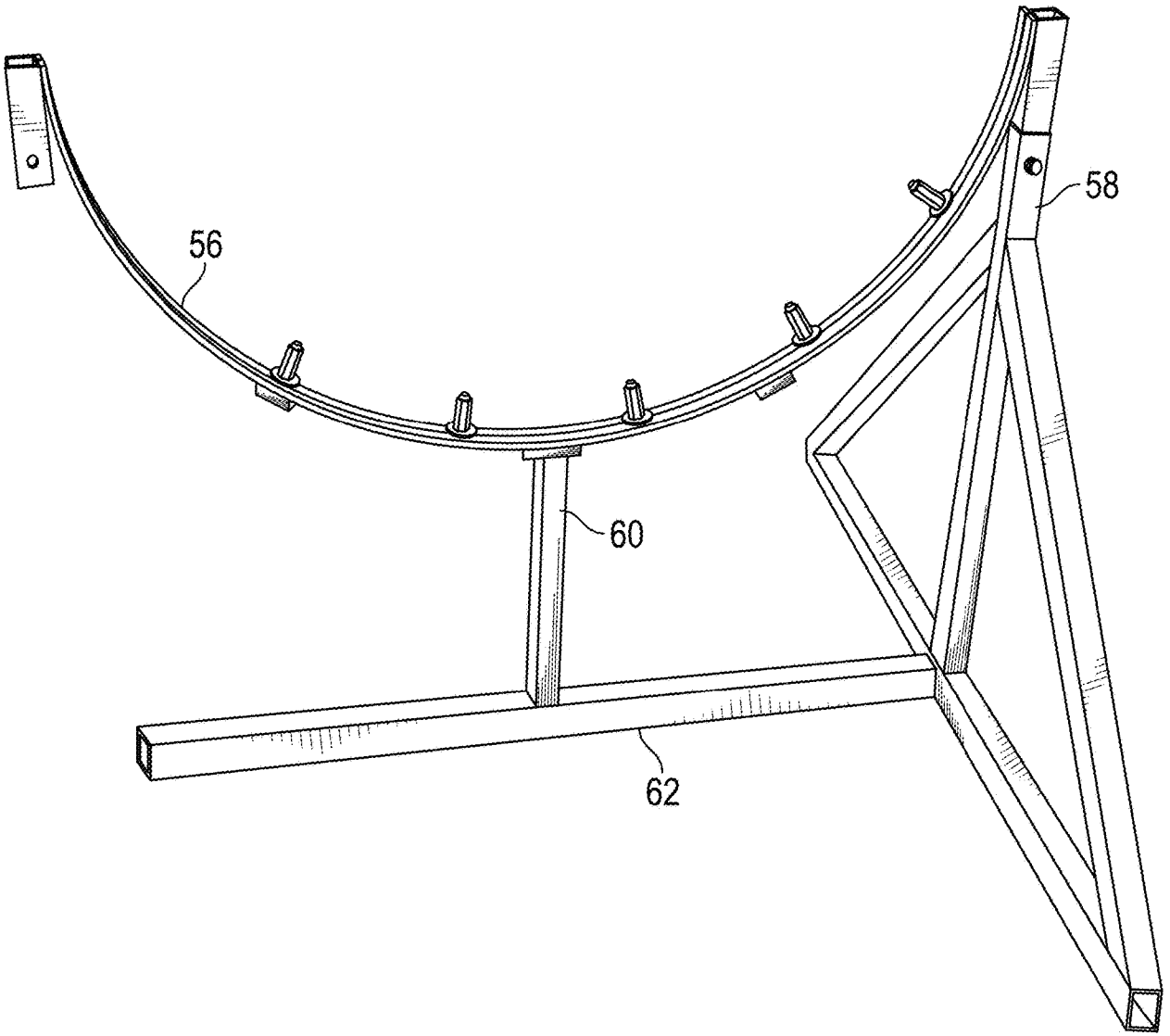
FIG. 3 is perspective view of an implementation of a stand and second member of a rebar jig.
Figure 4:
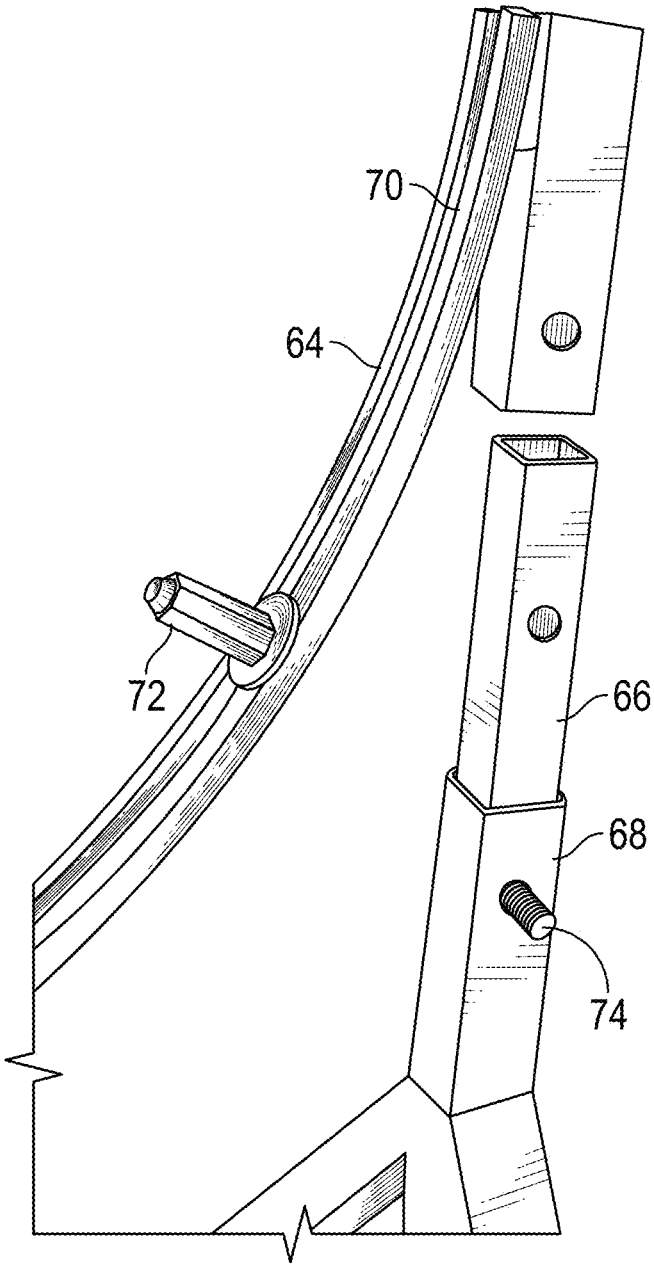
FIG. 4 is an exploded view of an implementation of a telescoping rod of an implementation of a rebar jig.

In FIGS. 3-8, various views of the ring and stand of an implementation of a rebar jig are illustrated. In FIG. 3, a perspective view of a second member 56 coupled to a second leg 58 and a second support bar 60 of a stand 62 is illustrated. FIGS. 4-7 illustrate coupling of a second member 64 to a telescoping rod inside a leg 66 of a stand of a rebar jig. In this view, a track 70 within the perimeter of the second member 64 of a ring is visible. In various implementations, three or more adjustable pegs 72 are included in the track 70 in a surface of the ring. The three or more adjustable pegs 72 may be secured through a washer and a nut as illustrated. In various implementations, the three or more pegs may include screws, pins, nails, dowels, rivets, brads, or other suitable fasteners known in the art. Referring to the leg 68 of the stand, an implementation of a pin 74 is shown securing the height of the leg 68 by coupling the leg and the telescoping rod 66. In this implementation, the end of the pin 74 is threaded. In other implementations, the end of pin may be smooth and secured by other means such as a clip 74 that secures the end of the pin.

Figure 5:
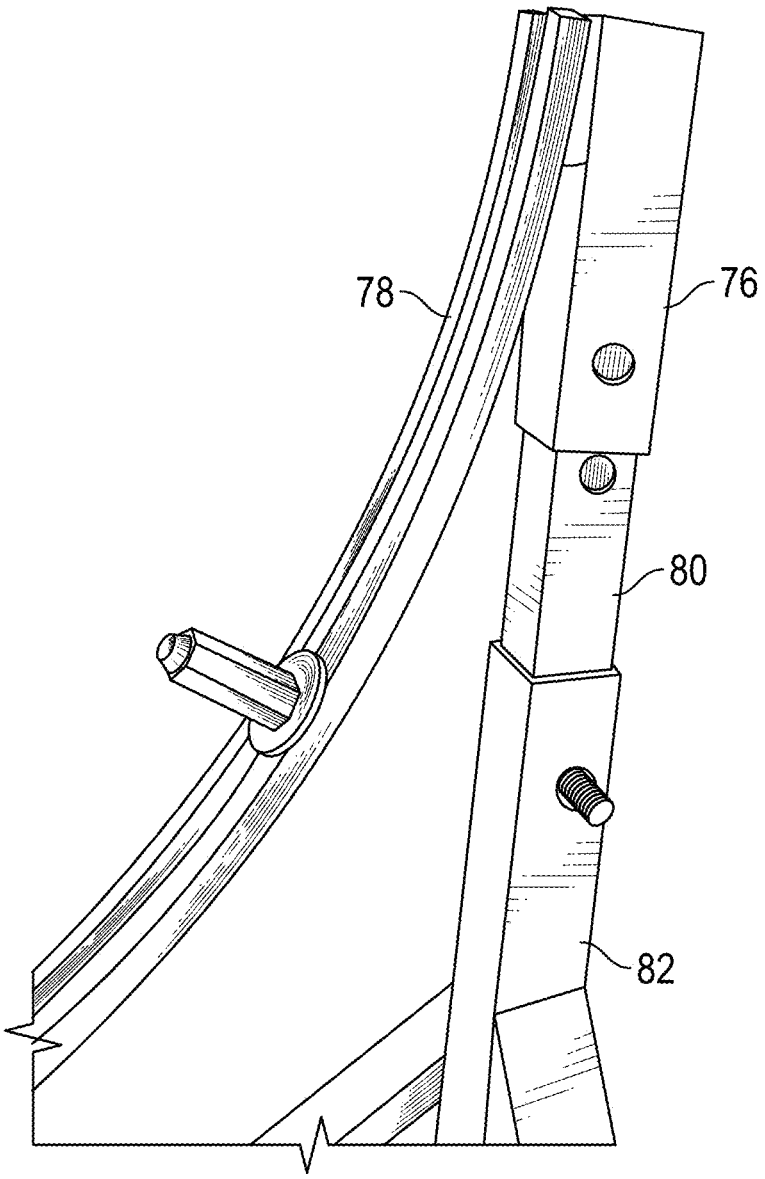
FIG. 5 is an exploded view of an implementation of a telescoping rod coupling to a ring of an implementation of a rebar jig.
Figure 6:
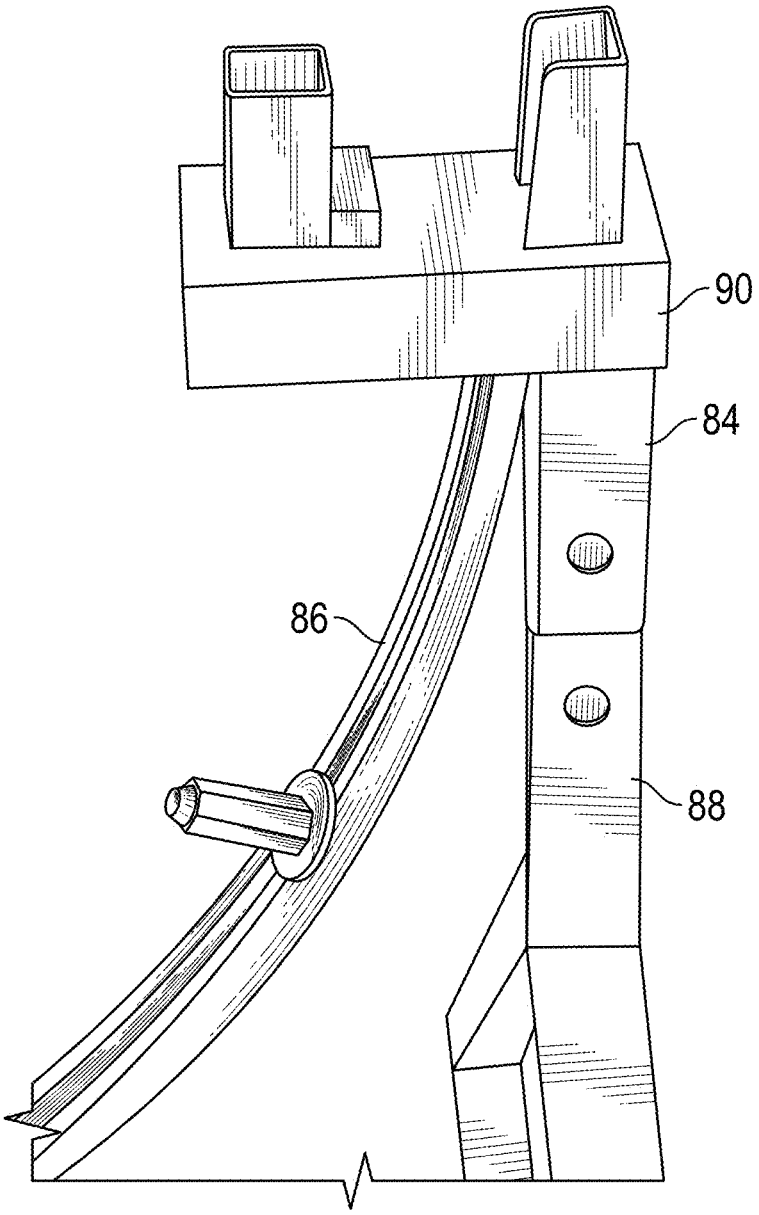
FIG. 6 is an exploded view of an implementation of a connector of an implementation of a rebar jig.
Figure 7:
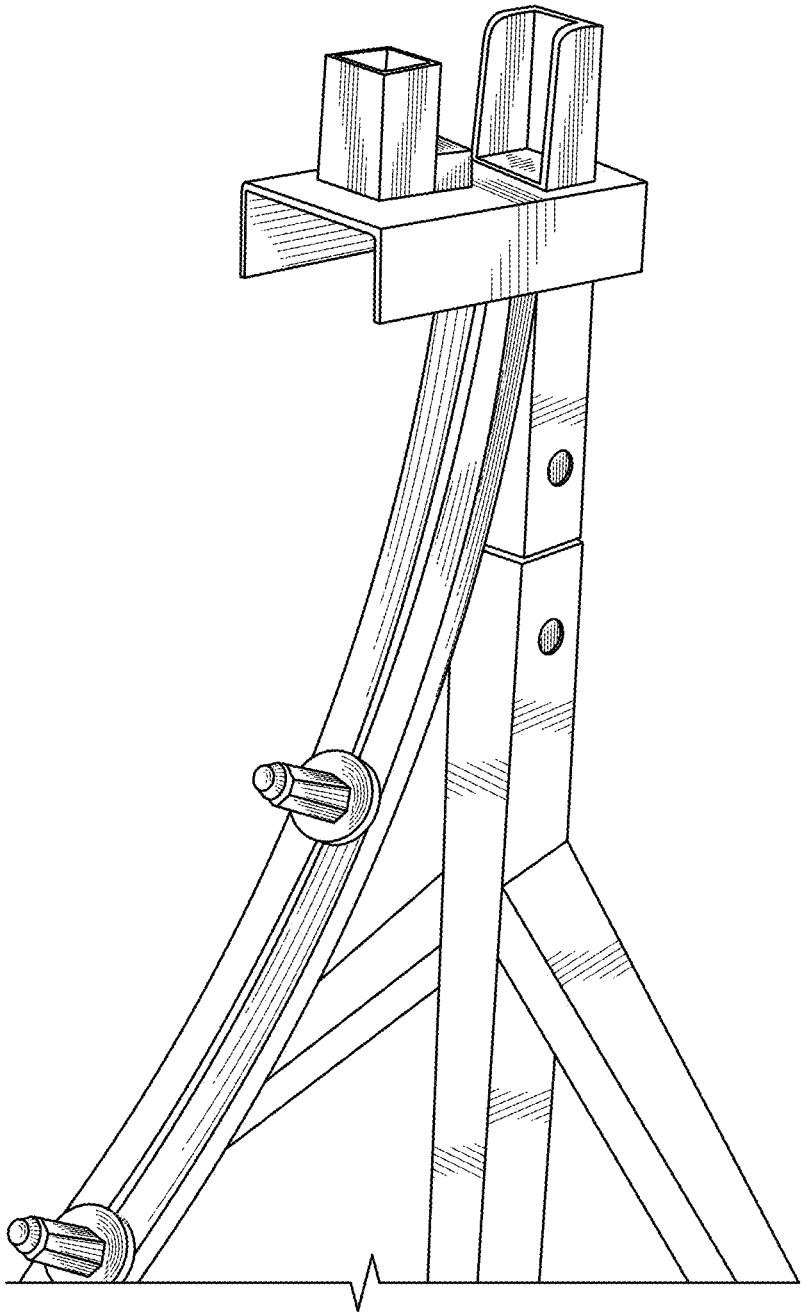
FIG. 7 is a perspective view of an implementation of a connector, a second member, and a stand of an implementation of a rebar jig.

The telescoping rod may have about 0.5 inch holes that are spaced about 3 inches apart. In other implementation, the holes may be different sizes and have different spaces between each. In FIG. 5, a coupler 76 of the second member 78 is shown sliding over a telescoping rod of a leg 82 of the stand. In FIG. 6, the coupler 84 of the second member 86 is shown flush with the top of the leg 88. In this position, the telescoping rod is not visible. However, in other implementations, the telescoping rod may be visible when the coupler 84 is fastened into position. In this view, a connector 90 is shown. A first member of a ring may be coupled to the connector 90 during a method of forming a rebar structure which will be described in further detail below. A perspective view of FIG. 6 is illustrated in FIG. 7.

Figure 8:
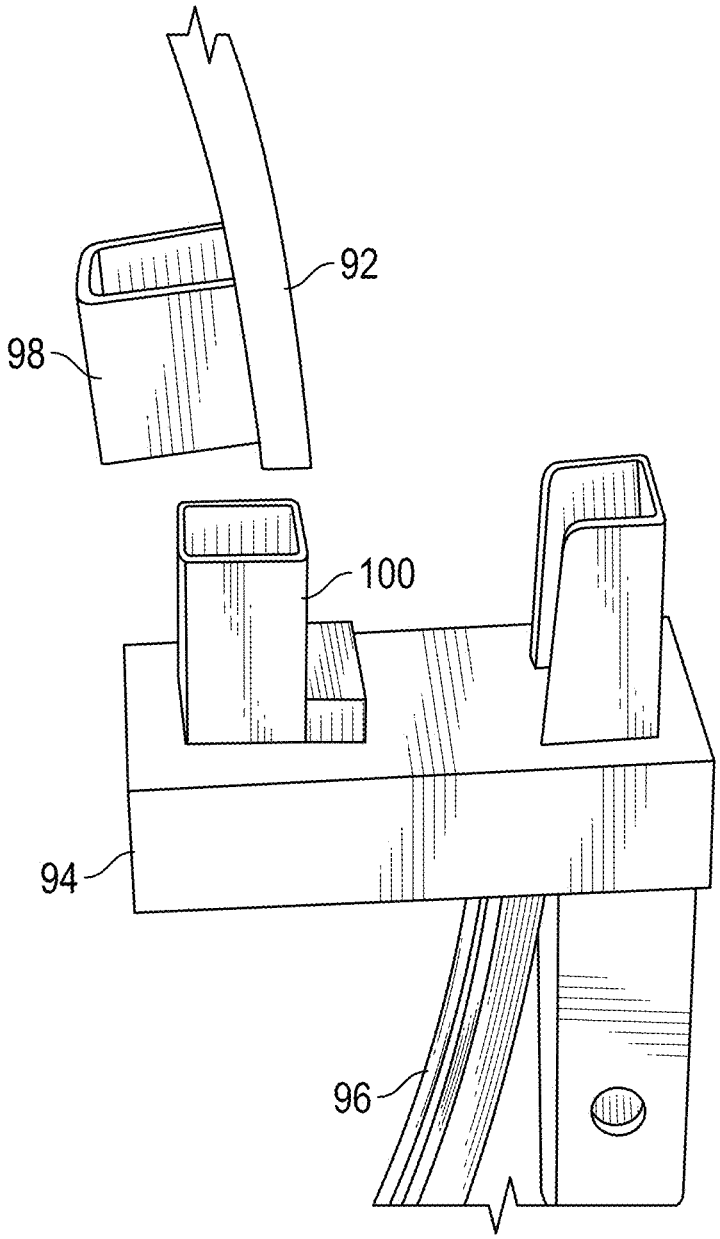
FIG. 8 is a perspective view of an implementation of a first member and a connector of an implementation of a rebar jig.

Referring to FIG. 8, a first member 92 coupling to a connector 94 is illustrated. The first member 92 may couple to the connector 94 after the connector has been coupled to the second member 96. In various implementations, three or more rebar may be coupled to the adjustable pegs of the second member before the first member is coupled to the connectors. The first member 92 may then be coupled to the connector 94 by sliding the sleeve/tubing 98 of the first member over the tubing 100 of the second member. After the first member 92 is secured, more rebar may be coupled to the first member 92. The rebar may be held in a desired position through the ring and substantially perpendicular to the ring. A rebar structure may be formed by coupling one or more substantially circular rebar to the three or more rebar in two or more places. The first member may then be removed from the rebar jig allowing space to remove the rebar structure from the second member of the rebar jig.

Figure 9:
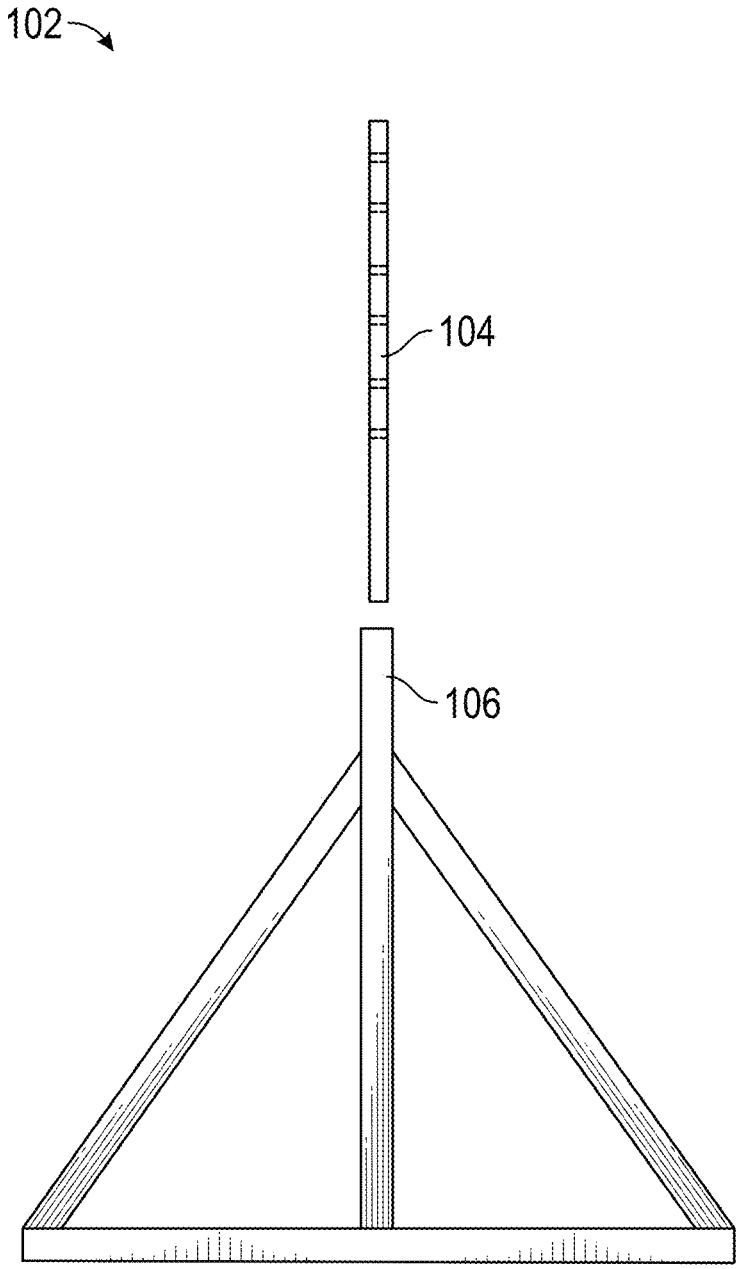
FIG. 9 is a side view of an implementation of a leg of a rebar jig.
Figure 10:
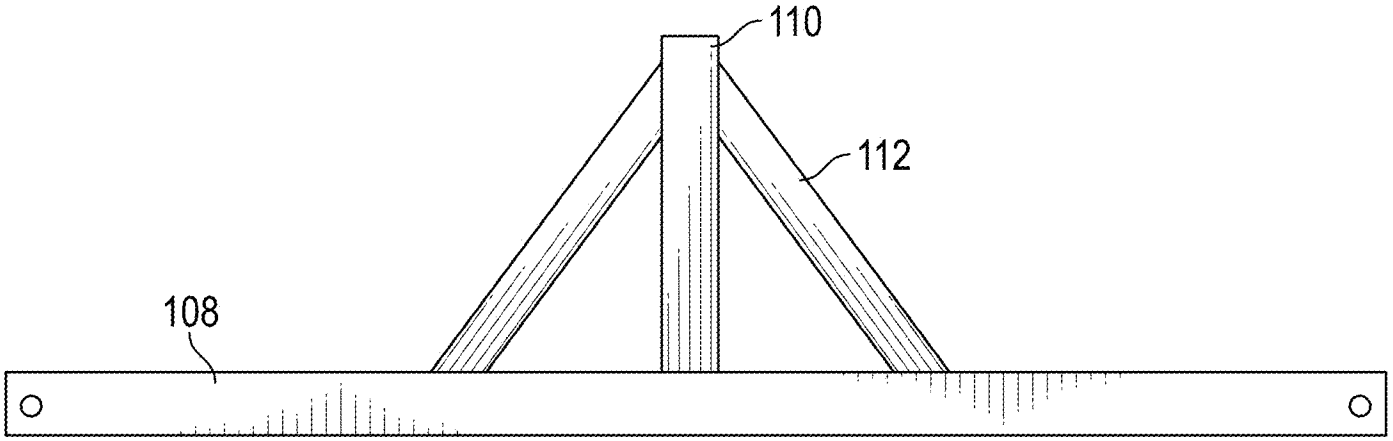
FIG. 10 is a front view of an implementation of a support bar of an implementation of a rebar jig.

Referring to FIG. 9, a side view of an implementation of a leg 102 of a rebar jig is illustrated. A side view of the telescoping rod 104 and a leg 106 of a stand is also illustrated. Referring to FIG. 10, a support bar 108 of a stand of a rebar jig is illustrated. The support bar 108 is coupled to a second support bar 110. In various implementations, the support bar 108 may also have additional bars 112 coupled on a diagonal between the support bar 108 and the second support 110 bar to brace the second support bar 110. The support bar also may include holes for securing the support bar to the telescoping portions of the legs of the stand as shown in previous figures.

Referring to FIG. 11, a top view 114 and a side view 116 of an implementation of a first member 118 of a ring is illustrated. A track 120 is included in the first member 118. The track is configured to receive three or more adjustable pegs as previously described. The sides of the first member are secured through three or more u-channels 122. Referring to FIG. 12, a bottom view 124, a top view 126, and a side view 128 of an implementation of a second member 130 of a ring is illustrated. The second member has u-channels 132 as described for the first member. This implementation of a second member 130 also shows an adjustable peg 134 included in the surface of the second member of the ring.

Figure 13:
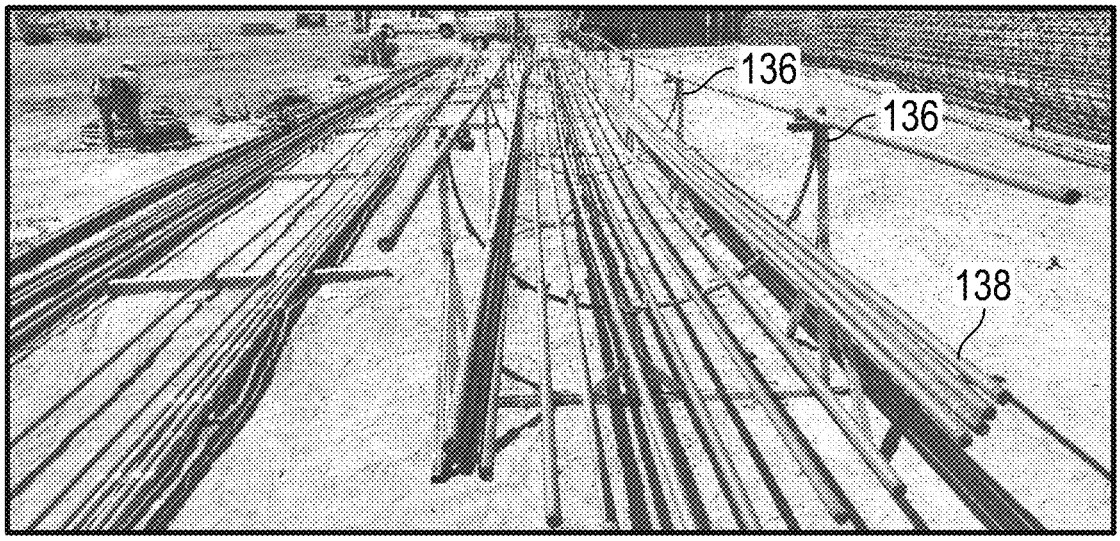
FIG. 13 is an illustration of several implementations of rebar jigs in use.
Figure 14:
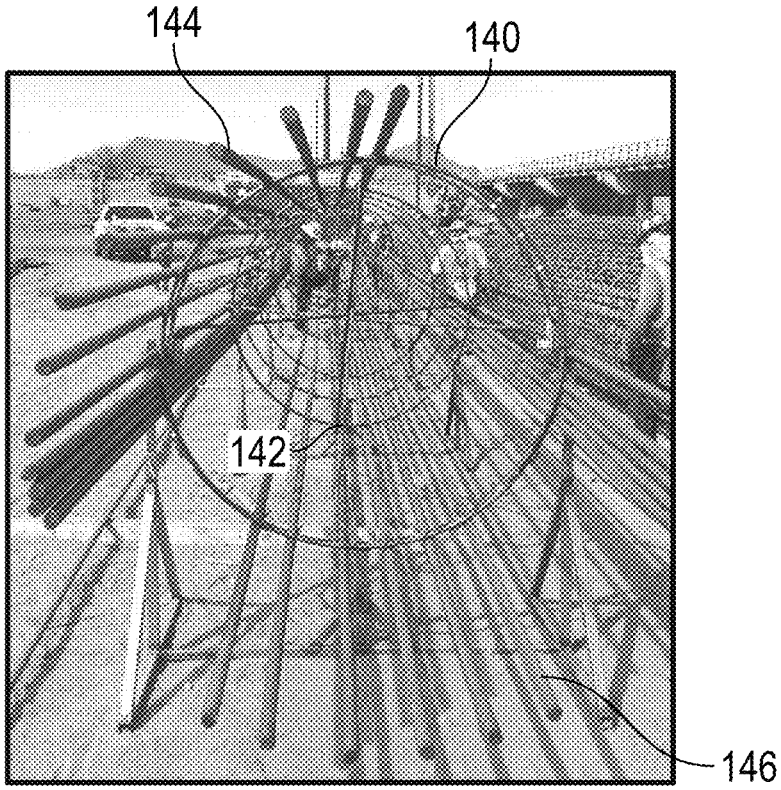
FIG. 14 is another illustration of several implementations of rebar jigs in use.

Referring to FIGS. 13 and 14, implementations of a method of forming a rebar structure using a plurality of rebar jigs is illustrated. In FIG. 13, several rebar jigs are shown placed a predetermined distance apart extending the desired length of the rebar structure. A plurality of rebar are coupled to a plurality of adjustable pegs included on the rebar jig. The plurality of rebar 138 are held in a desired position through the ring and substantially perpendicular to the ring. In various implementations, as shown in FIG. 14, the first member 140 of the ring is then coupled to the second member of the ring 142 through two or more connectors. Additional rebar 144 are then positioned on the outside of the first member 140 and in-line with the plurality of rebar 146 placed on the inside of the second member 144 of the ring. A rebar structure is formed by coupling one or more substantially circular rebar to the plurality of rebar in two or more places. Typically, this is done using wire to secure the substantially circular rebar to each of the plurality of rebar. In this way the rebar cage/structure is assembled together. The first member may be removed and then the rebar structure may be removed either manually or with heavy equipment.

In other implementations of a method for manufacturing a rebar structure a rebar jig may be provided. The rebar jig includes a ring having a first member and a second member. In various implementations, three or more rebar may be coupled to three or more adjustable pegs included on the rebar jig. The three or more rebar are held in a desired position through the ring substantially perpendicular to the ring. A rebar structure is then formed by coupling on or more substantially circular rebar to the three or more rebar in two or more places. The two or more places may include the two ends of the rebar structure. The rebar structure is then removed from the jig by removing either the first member or the second member of the ring from the jig. In implementations, the ring may include a shape including a circle, a rectangle, a triangle, an ellipse, and a square. The three or more adjustable pegs may be adjustable through a track comprised in a surface of the ring. The rebar jig may further comprise an adjustable stand. The adjustable stand may have an adjustable height and an adjustable width. The height of the stand, in various implementations, may adjust from about 31 inches to about 55 inches. The height may also be larger or smaller depending on the needs for construction. In various implementations, the width may be between about 41 inches and about 77 inches. In other implementations, the width may be smaller or larger.

In various implementations, the size of the jigs can be larger, between about 6 feet in diameter or across to 10 feet in diameter or across or larger. A wide variety of possible sizes and dimensions of jigs may be constructed using the principles disclosed herein.

In places where the description above refers to particular implementations of rebar jig and implementing components, sub-components, methods and sub-methods, it should be readily apparent that a number of modifications may be made without departing from the spirit thereof and that these implementations, implementing components, sub-components, methods and sub-methods may be applied to other rebar jigs.

What is claimed is:

1. A rebar jig comprising:

a ring comprising a first member and a second member, the first member configured to couple to the second member through a first connector and a second connector; and a stand comprising a first leg, a second leg, and a support bar, the support bar positioned between the first leg and the second leg;

wherein the ring is configured to receive three or more rebar thereon through at least three pegs coupled to a perimeter of the ring;

wherein the stand couples with the ring through two or more couplers; and wherein a first peg of the at least three pegs extends from the ring away from a center of the ring and a second peg of the at least three pegs extends from the ring towards a center of the ring.

2. The rebar jig of claim 1, wherein the ring comprises a shape including one of a circle, a rectangle, a triangle, an ellipse, and a square.

3. The rebar jig of claim 1, further comprising a second support bar extending from the support bar to couple with the second member of the ring.

4. The rebar jig of claim 1, wherein the two or more couplers are secured to the stand through two or more pins.

5. The rebar jig of claim 1, wherein the first connector and the second connector are secured to the ring through one or more pins.

6. The rebar jig of claim 1, wherein the first leg and the second leg have a height and the height is adjustable through a telescoping rod comprised therein.

7. The rebar jig of claim 1, wherein the support bar has a width and the width is adjustable through use of telescoping portions coupled to both the first leg and to the second leg.

8. A rebar jig comprising:

a ring comprising a first member and a second member, each of the first member and the second member comprising two or more adjustable pegs each configured to receive a rebar;

a connector configured to couple the first member with the second member; and a stand comprising a first leg, a second leg, and a support bar coupled between the first leg and the second leg, each leg comprising a first portion and a second portion;

wherein the ring couples to each of the first leg, the second leg, and the support bar of the stand through two or more couplers; and wherein the two or more adjustable pegs of the first member extend from the first member away from a center of the ring and the two or more adjustable pegs of the second member extend from the second member towards the center of the ring.

9. The rebar jig of claim 8, wherein the ring comprises a shape including one of a circle, a rectangle, a triangle, an ellipse, and a square.

10. The rebar jig of claim 8, wherein the two or more adjustable pegs are adjustable through a track comprised in a surface of the ring.

11. The rebar jig of claim 8, further comprising a second support bar extending from the support bar to couple with the second member of the ring.

12. The rebar jig of claim 8, wherein the two or more couplers are secured to the stand through two or more pins.

13. The rebar jig of claim 8, wherein the connector is secured to the ring through one or more pins.

14. The rebar jig of claim 8, wherein the second portion of each of the first leg and the second leg has an adjustable height through a telescoping rod comprised therein.

15. The rebar jig of claim 8, wherein the support bar has a width and the width is adjustable through use of telescoping portions coupled to both the first leg and to the second leg.

* * * * *